US007040609B1

(12) United States Patent
Liou

(10) Patent No.: US 7,040,609 B1
(45) Date of Patent: May 9, 2006

(54) CLAMPING FIXTURE

(76) Inventor: Ferng-Jong Liou, No. 48-1, Cheng Fong Lane, Taiming Rd., Wu Jih, Taichung (TW)

( * ) Notice: Subject to any disclaimer, the term of this patent is extended or adjusted under 35 U.S.C. 154(b) by 0 days.

(21) Appl. No.: 11/258,238

(22) Filed: Oct. 26, 2005

(51) Int. Cl.
*B25B 1/00* (2006.01)

(52) U.S. Cl. ..... 269/6; 269/3

(58) Field of Classification Search ..... 269/6, 269/3, 166–171.5, 147–150, 4, 283–284
See application file for complete search history.

(56) References Cited

U.S. PATENT DOCUMENTS 5,222,420 A * 6/1993 Sorensen et al. ..... 81/487
5,454,551 A * 10/1995 Hobday ..... 269/6
6,578,837 B1 * 6/2003 Blank et al. ..... 269/6
6,648,314 B1 * 11/2003 Degen et al. ..... 269/6
6,848,683 B1 * 2/2005 Foshag et al. ..... 269/3
2004/0245692 A1 * 12/2004 Brass et al. ..... 269/3

* cited by examiner

*Primary Examiner*—Lee D. Wilson
(74) *Attorney, Agent, or Firm*—Troxell Law Office, PLLC

(57) ABSTRACT

A clamping fixture includes a gauge rod having a fixed and a movable jaw mounted thereon, a lever-like handle, and a shift plate having a lower slot, via which the gauge rod is extended. The shift plate is connected to a rear side of the movable jaw via two shafts having compression springs mounted thereon. When the handle is downward pulled, a roller on the handle pushes the shift plate to turn clockwise, bringing the slot into an inclined position to firmly press against the gauge rod and thereby becomes immovable to stop the movable jaw from moving. The handle has a nut engaged with a screw rod mounted on the movable jaw. When the screw rod is turned, the nut and accordingly the handle are axially finely adjusted until a workpiece is firmly clamped between the two jaws.

3 Claims, 6 Drawing Sheets

CLAMPING FIXTURE

FIELD OF THE INVENTION

The present invention relates to a clamping fixture, and more particularly to a clamping fixture provided with a lever-like handle for conveniently locking a shift plate in place and preventing a movable jaw of the fixture from moving along a gauge rod, so as to firmly clamp a workpiece between the movable jaw and a fixed jaw.

BACKGROUND OF THE INVENTION

FIG. 1 shows a conventional clamping fixture, in which a movable jaw C fixedly mounted to an end of a gauge rod D is held in place via a trigger A located at a lower portion of the clamping fixture. When the trigger A is pulled, a shift plate E located immediately behind the trigger A is brought into an inclined position, such that a through slot B provided on the shift plate E also becomes inclined to tightly press against and there by push and move the gauge rod D that extends through the slot B, so that the movable jaw C fixedly mounted on the gauge rod D is moved to a desired position.

The above-structured conventional clamping fixture has the following disadvantages:

1. Since the trigger A is located at a lower portion of the clamping fixture, it must be pulled rearward using a finger to push the shift plate E into an inclined position.
2. A user has to exert efforts to hold the clamping fixture when the trigger A bears a relatively heavy load.
3. The user's finger would become sore and uncomfortable when the rigid trigger A of the clamping fixture has been continuously operated many times.

Therefore, it is tried by the inventor to develop an improved clamping fixture to overcome the drawbacks in the conventional clamping fixture.

SUMMARY OF THE INVENTION

A primary object of the present invention is to provide a clamping fixture, in which a handle for locking a movable jaw in place is located above the gauge rod and can therefore be downward operated like a lever with reduced efforts due to the gravitational inertia, making the clamping fixture more convenient and efficient for use.

To achieve the above and other objects, the clamping fixture according to the present invention includes a gauge rod, a fixed jaw locked to an end of the gauge rod, a movable jaw mounted on the gauge rod opposite to the fixed jaw, a lever-like handle connected to the movable jaw, and a shift plate mounted on the gauge rod to locate closely behind and connect to the movable jaw. A roller is mounted near an upper end of the handle in contact with the shift plate, and the shift plate is provided near a lower end with a slot, through which the gauge rod is extended. When the handle is downward pulled, the roller pushes the shift plate to turn clockwise, bringing the slot on the shift plate into an inclined position to firmly press against the gauge rod and thereby becomes immovable on the gauge rod. A screw rod with a turning knob is connected to the movable jaw and engaged with a nut on the handle. When the knob is turned, the nut and accordingly the handle are finely adjusted in their axial position until a workpiece is very firmly clamped between the two jaws.

In the present invention, the shift plate is connected to the movable jaw via two shafts having compression springs mounted thereon. When the handle is released, the compression springs automatically push the shift plate to the initial vertical position, allowing the movable jaw to move along the gauge rod again.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
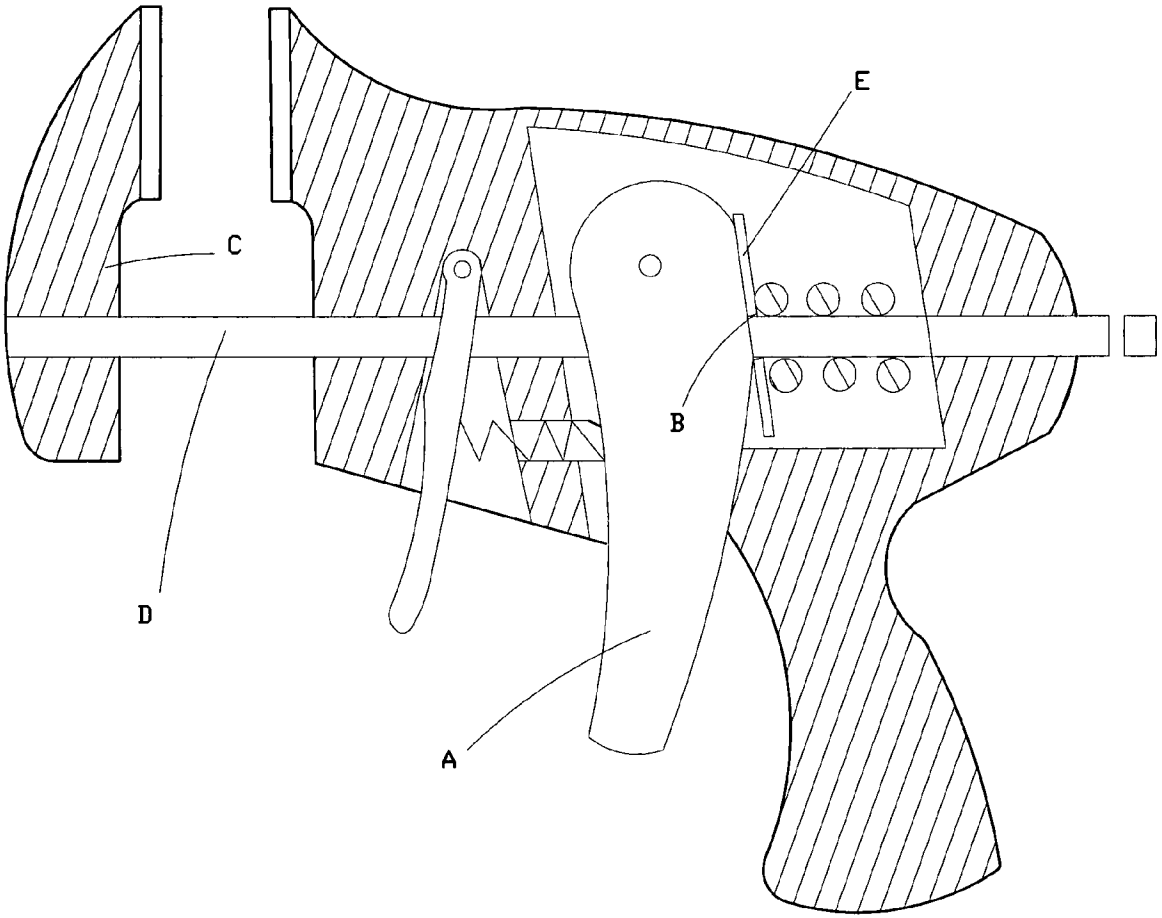
FIG 1 PRIOR ART
FIG. 1 shows a conventional clamping fixture.
Figure 2:
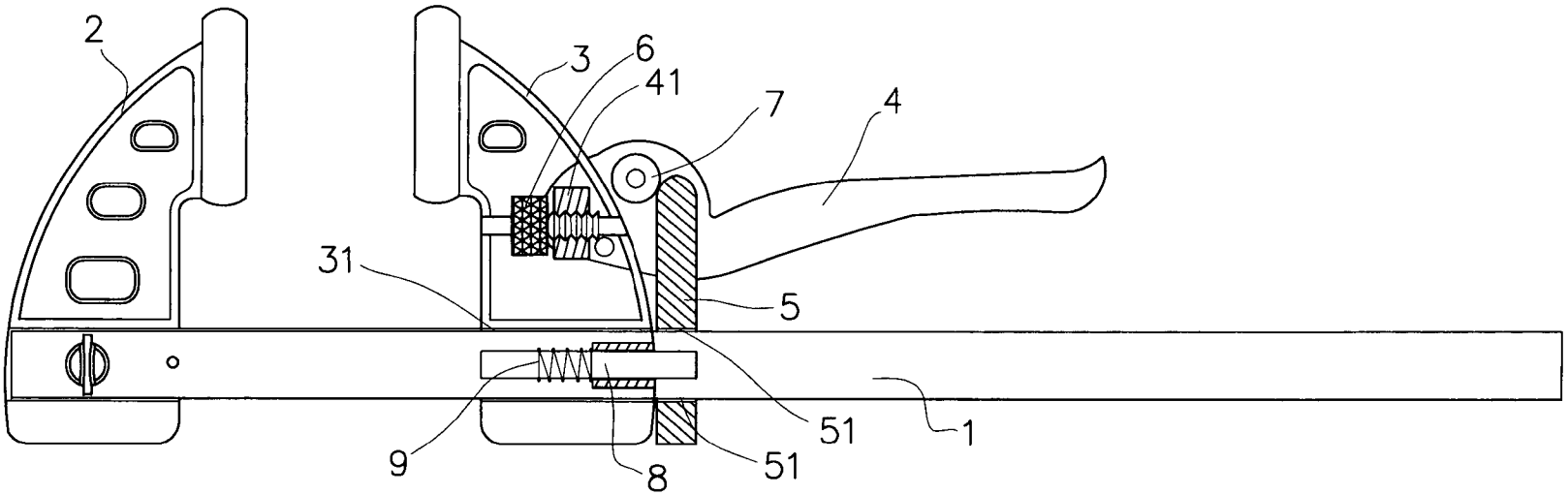
FIGS. 2 and 3 are partially sectioned side views of a clamping fixture according to the present invention.
Figure 3:
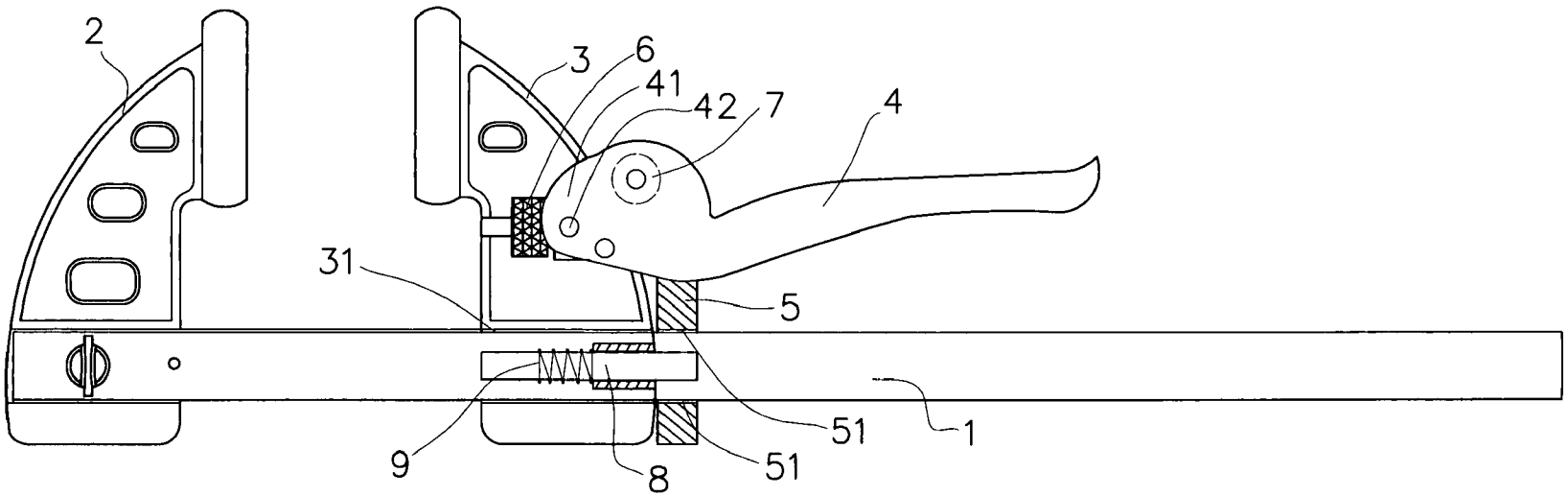

Please refer to FIGS. 2 and 3 that are two partially sectioned side views of a clamping fixture according to the present invention. As shown, the clamping fixture includes a gauge rod 1, a fixed jaw 2, a movable jaw 3, a handle 4, and a shift plate 5.

The fixed jaw 2 is locked to an end of the gauge rod 1. The movable jaw 3 is provided at a lower portion with a horizontal groove 31, with which the gauge rod 1 is engaged to allow the movable jaw 3 to linearly reciprocate along the gauge rod 1.

The handle 4 works as a lever, and has a nut 41 connected to one side of a front end thereof using a shaft 42. The nut 41 is mounted on a screw rod having a turning knob 6. Two ends of the screw rod are separately fixedly connected to front and rear frames of the movable jaw 3. When the turning knob 6 is turned, the nut 41 is brought to move forward or backward along the screw rod, and the handle 4 is moved along with the nut 41. In this manner, the handle 4 can be finely adjusted in its axial position relative to the movable jaw 3.

A roller 7 is fixedly screwed to the handle 4 at a position slightly behind the nut 41, so that one side of the roller 7 opposite to the nut 41 is in contact with the shift plate 5, which is vertically mounted on the gauge rod 1 closely behind the movable jaw 3.

The shift plate 5 is provided near a lower end with a through slot 51, through which the gauge rod 1 is extended. Two shafts 8 are separately extended from two lateral sides of the slot 51 with their distal ends connected to positions near a lower frame of the movable jaw 3. Each of the two shafts 8 has a compression spring 9 mounted thereon. With these arrangements, a first set of two supporting points are formed at joints of the distal ends of the shafts 8 and the movable jaw 3, and a second set of two supporting points are formed at joints of the proximal ends of the shafts 8 and the shift plate 5.

When the handle 4 is pivotally turned downward, the roller 7 is simultaneously moved downward to push against the shift plate 5, causing the shift plate 5 to turn clockwise about the second set of supporting points and compress the compression springs 9 mounted on the two shafts 8. As a result, the slot 51 formed near the lower end of the shift plate 5 has upper and lower sides that are no longer in parallel with the gauge rod 1, but become inclined relative to the gauge rod 1 to firmly press against the gauge rod 1 and produce a brake effect on the movable jaw 3. That is, the slot 51 in the inclined position has upper and lower sides firmly pressed against upper and lower surfaces of the gauge rod 1, making the shift plate 5 and the movable jaw 3 immovable on the gauge rod 1. When the handle 4 is released, a restoring force of the compression springs 9 mounted on the two shafts 8 automatically pushes the shift plate 5 to an initial vertical position, so that the upper and lower sides of the slot 51 are parallel to the gauge rod 1 again.

Figure 4:
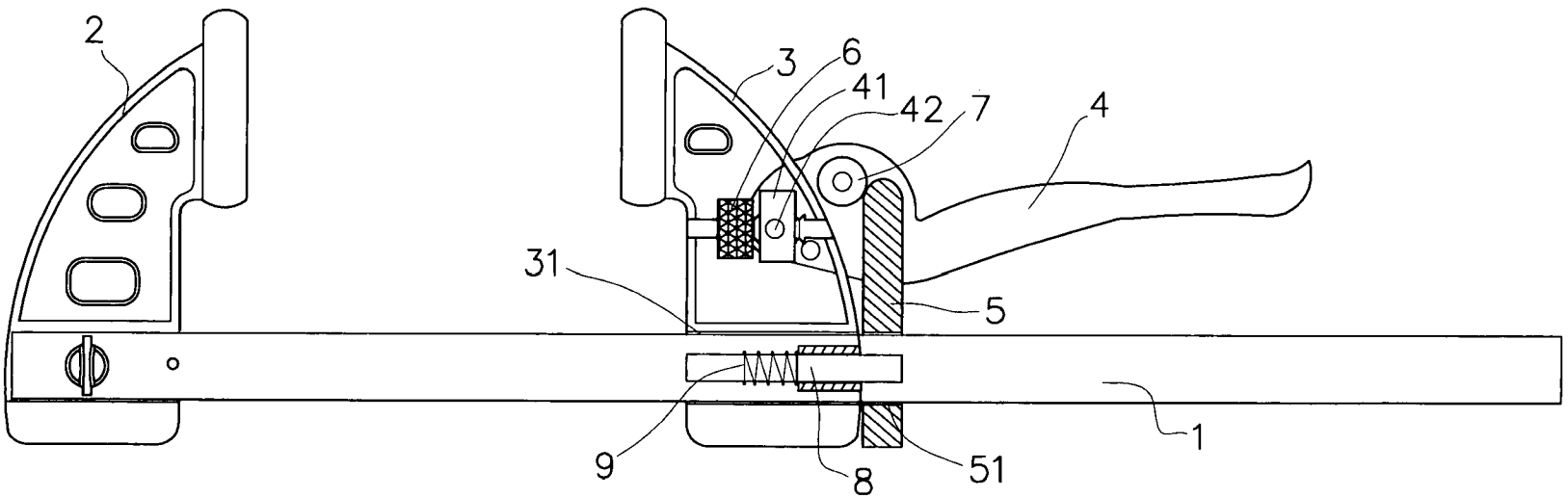
FIG. 4 shows the clamping fixture of the present invention is ready to clamp a workpiece in place.
Figure 5:
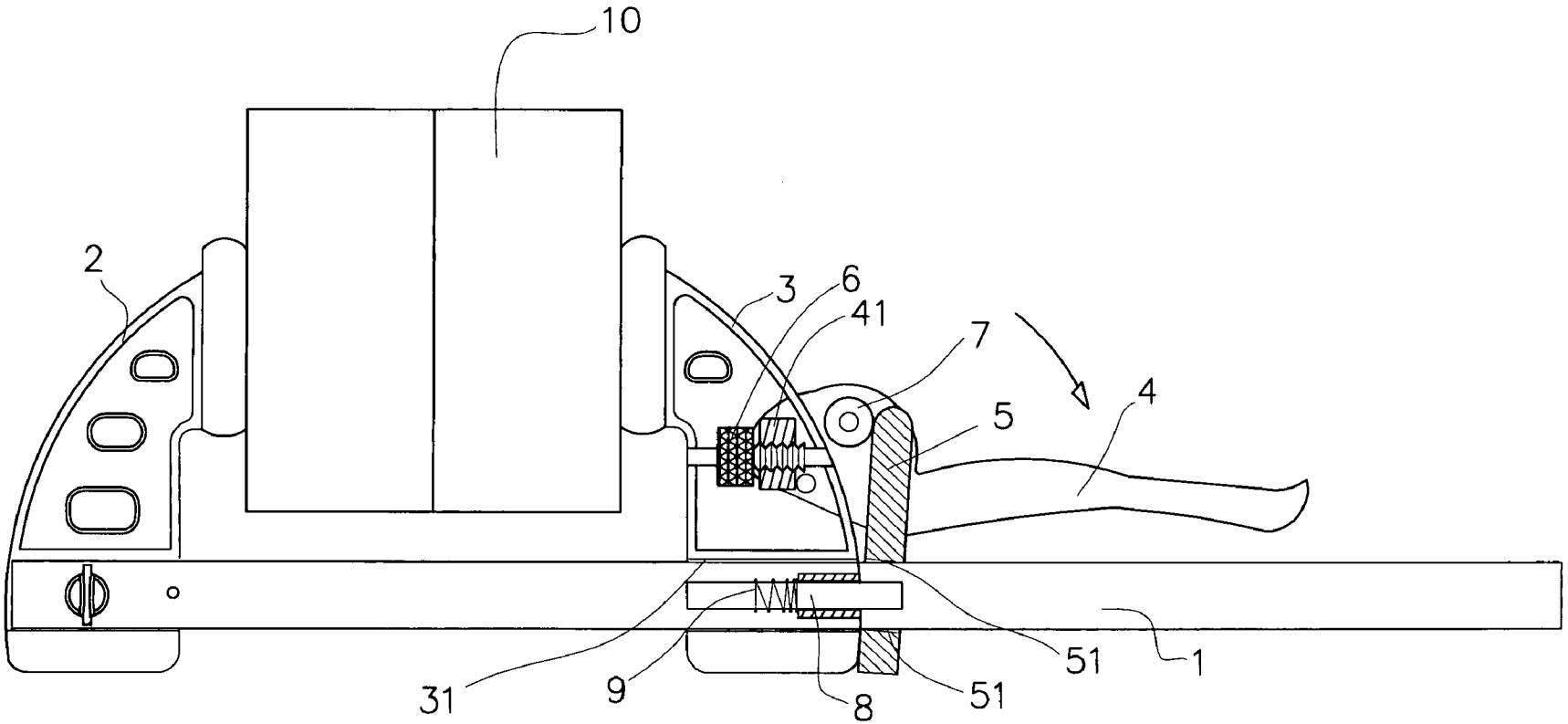
FIG. 5 shows the clamping fixture of the present invention with a handle thereof in a downward pushed position.
Figure 6:
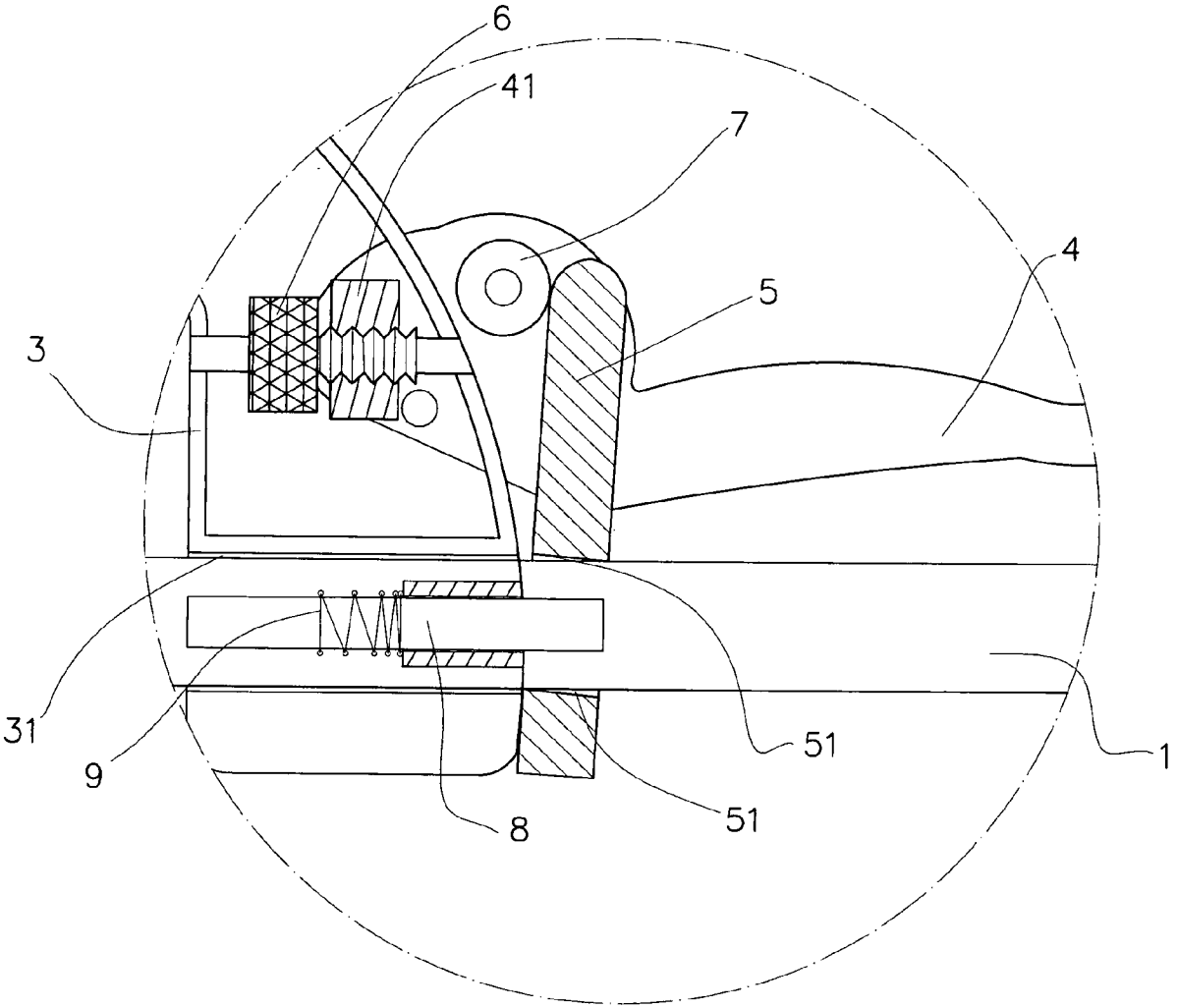
FIG. 6 is a fragmentary and enlarged view of FIG. 5.

Please refer to FIGS. 4 and 5. When it is desired to use the clamping fixture of the present invention to firmly clamp a workpiece 10 between the fixed and the movable jaw 2, 3, simply downward pull the handle 4 for the roller 7 to push against the shift plate 5. At this point, the shift plate 5 would turn clockwise about the second set of supporting points at the joint of the shift plate 5 and the proximal ends of the two shafts 8 to a predetermined inclination, as can be very clearly seen from FIG. 6. The slot 51 provided near the lower end of the shift plate 5 is also brought to an inclined position with its upper and lower sides firmly pressing against the upper and lower surfaces of the gauge rod 1. Then, the turning knob 6 on the screw rod may be turned to finely adjust the position of the nut 41 and accordingly the handle 4, so that the handle 4 is brought to shift forward until the workpiece 10 is absolutely firmly clamped between the two jaws 2, 3.

To release the workpiece 10 from the jaws 2, 3, simply loosen the turning knob 6 on the screw rod and upward push the handle 4 with a minor force, the compression springs 9 would automatically return the shift plate 5 to the initial vertical position and bring the upper and lower sides of the slot 51 to parallel with the upper and lower surfaces of the gauge rod 1 again. At this point, the movable jaw 3 may be freely moved along the gauge rod 1 to other desired position.

What is claimed is:

1. A clamping fixture, comprising a gauge rod, a fixed jaw locked to an end of said gauge rod, a movable jaw movably mounted on said gauge rod opposite to said fixed jaw, a handle connected to said movable jaw, and a shift plate mounted on said gauge rod to locate closely behind and connect to said movable jaw; and said handle having a nut fixed near a front end of said handle using a shaft, said nut is mounted on a screw rod having a turning knob provided thereon, and said screw rod being connected at two ends to front and rear frames of said movable jaw, whereby when said turning knob is turned, said nut is caused to move forward or backward along said screw rod.

2. The clamping fixture as claimed in claim 1, wherein said handle further has a roller mounted thereon to locate slightly behind said nut with one side opposite to said nut in contact with said shift plate.

3. The clamping fixture as claimed in claim 2, wherein said shift plate is provided near a lower end with a slot, through which said gauge rod is extended to abut upper and lower surfaces against upper and lower sides, respectively, of said slot; and two shafts being horizontally extended from two lateral sides of said slot with two distal ends of said two shafts connected to positions near a lower frame of said movable jaw, and each of said two shafts having a compression spring mounted thereon.

* * * * *